United States Patent [19]

Towner et al.

[11] Patent Number: 4,628,994

[45] Date of Patent: Dec. 16, 1986

[54] OIL WELLS

[75] Inventors: John E. T. Towner; Geoffrey F. Towner, both of Victoria Park, Australia

[73] Assignee: Texaust Australia Limited, Canberra, Australia

[21] Appl. No.: 734,187

[22] Filed: May 15, 1985

[30] Foreign Application Priority Data

May 15, 1984 [AU] Australia ..... PG5002

[51] Int. Cl.[4] ..... E21B 43/00

[52] U.S. Cl. ..... 166/68; 166/106; 417/543

[58] Field of Search ..... 166/68, 106, 369; 417/543

[56] References Cited

U.S. PATENT DOCUMENTS

| | | | |
|---|---|---|---|
| 2,215,558 | 9/1940 | Miller | 417/543 |
| 2,764,103 | 9/1956 | Mercier | 417/543 |
| 3,198,133 | 8/1965 | Elliott | 417/543 |
| 4,372,389 | 2/1983 | Hamrick et al. | 166/106 |
| 4,445,829 | 5/1984 | Miller | 417/543 |

*Primary Examiner*—Stephen J. Novosad
*Assistant Examiner*—William P. Neuder

[57] ABSTRACT

The invention relates to an oil well comprising a production tubular with a pump barrel attached to its lower end, a reciprocable oil pump having a plunger located within the pump barrel, a sucker rod string extending downwardly from ground level to the plunger for reciprocating the plunger, means for cyclically raising the sucker rod string, a chamber located and arranged so as to be open to oil pressure immediately above the plunger, wherein the chamber is located externally of the production tubular, the chamber is in communication with the interior of the production tubular and the chamber contains a resilient bladder member arranged to occupy normally substantially the whole volume of the chamber to be connected to a source of pressurized gas through a non-return valve, to contain and maintain gas at the static oil pressure and to occupy a reduced volume of the chamber when the oil pressure immediately above the plunger increases due to pressure surges arising from elastic deformation of a column of oil.

5 Claims, 2 Drawing Figures

OIL WELLS

DESCRIPTION

1. Technical Field

The present invention relates to oil wells.

2. Background Art

Australian Patent Application No. 14243/83 relates to an oil well comprising a production tubular with a pump barrel attached to its lower end, a reciprocable oil pump having a plunger located within the pump barrel, a sucker rod string extending downwardly from gound level to the plunger for reciprocating the plunger, means for cyclically raising the sucker rod string, a gas chamber located and arranged so as to be open to oil pressure immediately above the plunger and means for charging and maintaining pressurised gas within the chamber.

In the preferred embodiments described in Australian Patent Application No. 14243/83, the sucker rod string is hollow, the pulsation dampener chamber is located within the sucker rod string, and the means for charging pressurised gas into the chamber is a non-return valve located adjacent the upper end of the sucker rod string.

Australian Patent Application No. 14243/83 also describes and claims a reciprocable oil pump, a sucker rod string and a method of preventing the initiation of pressure surges when artificially lifting oil.

Australian Patent Application No. 14243/83 also relates to an oil well in which a gas chamber may be located externally of the production tubular which has the advantage of being able to use a conventional sucker rod string whilst still preventing the initiation of pressure changes when artificially lifting oil.

DISCLOSURE OF THE INVENTION

In accordance with one aspect of the present invention there is provided an oil well comprising a production tubular with a pump barrel attached to its lower end, a reciprocable oil pump having a plunger located within the pump barrel, a sucker rod string extending downwardly from ground level to the plunger for reciprocating the plunger, means for cyclically raising the sucker rod string, a gas chamber located and arranged so as to be open to oil pressure immediately above the plunger, wherein the chamber is located externally of the production tubular, the chamber is in communication with the interior of the production tubular and the chamber contains a resilient bladder member arranged to be connected to a source of pressurised gas through a non-return valve, to contain and maintain gas at the static oil pressure and to occupy a reduced volume of the chamber when the oil pressure immediately above the plunger increases. In accordance with a further aspect of the present invention there is provided a method of preventing the initiation of pressure surges when artificially lifting oil which comprises establishing a column of oil in an oil well, said oil well comprising a production tubular with a pump barrel attached to its lower end, a reciprocable oil pump having a plunger located within the pump barrel, a sucker rod string extending downwardly from ground level to the plunger for reciprocating the plunger, means for cyclically raising the sucker rod string, a controlled pressure gas chamber located and arranged so as to be open to oil pressure immediately above the plunger, said chamber being located externally of the production tubular, the chamber being in communication with the interior of the production tubular and the pulsation dampener chamber containing a resilient bladder member which occupies normally substantially the whole volume of the chamber, is connected to a source of pressurised gas through a non-return valve and contain and maintain gas at the static oil pressure, imparting lift to the column by means of the sucker rod string and plunger and removing increases in pressure caused by elastic deformation of the column of oil by means of entry of a quantity of oil into the chamber which causes the bladder member to occupy temporarily a reduced volume of the chamber.

BRIEF DESCRIPTION OF THE DRAWINGS

The present invention will now be described, by way of example, with reference to the accompanying drawings in which.

BEST MODE FOR CARRYING OUT THE INVENTION

Figure 1:
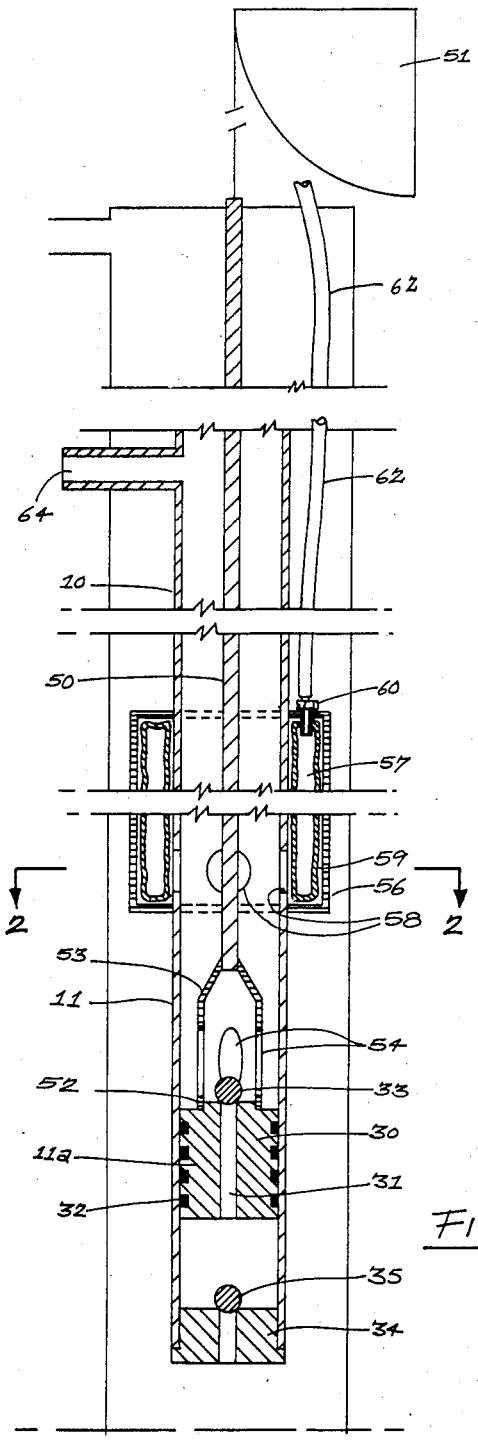
FIG. 1 is a vertical section through the production tubular and pump barrel of an oil well in accordance with one embodiment of the present invention.
Figure 2:
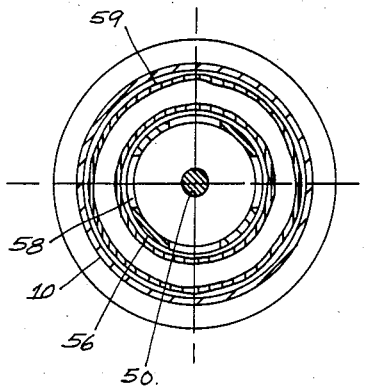
FIG. 2 is a section along the line 2—2 of FIG. 1.

In FIGS. 1 and 2, the oil well comprises a production tubular 10 with a pump barrel 11 attached to its lower end. A solid sucker rod string 50 of conventional jointed form reciprocates in the production tubular 10 to drive a pump plunger 11*a*, located in the pump barrel 11, up and down to lift the oil on the up-stroke. The sucker rod string 50 is coupled between a reciprocating power source 51 and a plunger section 52 containing the plunger 11*a*.

The plunger 11*a* comprises a piston 30 having a central aperture 31 extending therethrough. The outer surface of the piston 30 is provided with a plurality of sealing rings 32 which provide a seal between the piston 30 and the pump barrel 11 in use.

A ball 33 is arranged to be seated in the upper end of the central aperture 31. Further, at the lower end of the pump barrel 11 there is provided a reduced diameter section 34 having a second ball 35 seated thereon. In use, the ball 33 will allow oil to pass through the piston 30 via the aperture 31 on a downward stroke of the sucker rod string 50. The second ball 35 remains seated during this movement. Thus, the oil will enter the space above the piston 30.

Similarly, on an upward stroke of the sucker rod string 50 the second ball 35 will rise from its seat and allow oil to enter the space below the piston 30. The first ball 33 remains seated during this movement.

The plunger section 52 contains an upper hollow portion 53 with a plurality of apertures 54. An annular jacket 56 is mounted externally of and extends around the production tubular 10. The jacket 56 communicates with the interior of the production tubular 10 through a plurality of apertures 58 located just above the hollow portion 53. The jacket 56 defines a chamber 57.

The jacket 56 has a non-return gas valve 60 mounted in its upper end, which gas valve 60 is connected via conduit 62 to a source of pressurised gas (not shown) at ground level.

The chamber 57 contains a hollow annular resilient tube 59 with a wall formed of, for example, synthetic rubber. The tube 59 is in communication with the valve 60 and is arranged to be inflated to a pressure which is dependent on the weight of fluid in the production tubular 10 and the depth of the chamber 57. The tube 59 is arranged to be inflated to a gas pressure equivalent to the static oil pressure in the tubular 10 and normally occupies substantially the whole volume defined by the jacket 56 except when pressure increases caused by elastically generated pressure waves causes oil to enter the chamber 57. This compresses the tube 59.

On the downward stroke, the hollow portion 53 fills with oil and this oil passes into the production tubular via the apertures 54. On the upward stroke the oil is lifted by the plunger 11a. A quantity of oil leaves the column by an upper outlet 64.

In order to absorb the elastic deformation set up in the column of oil because of the difference between the coefficients of elasticity of the production tubular 10 and the column of oil, some oil temporarily enters the chambers 57 through the apertures 58. The movement of the oil into the chamber 57 defined by the jacket 56 removes the excess volume of oil and substantially reduces the pressure in the surge.

Thus, when the tendency towards pressure build up has eased the oil in the chamber 57 defined by the jacket 56 will flow out through the apertures 58 back into the production tubular 10. The inflated tube 59 will then revert back to the static oil pressure.

The tube 59 can be recharged with gas and the pressure therein can be maintained through the conduit 62 and valve 60 as required. A minute orifice may be provided in the valve 60 immediately before entry to the tube 59. A capillary tube extends from this orifice and leads into the oil in the production tubular as low as possible above the delivery valve 33 into the tubular. This capillary tube acts as a relief valve to release excess pressure from the tube 59.

The present invention reduces the impact of elastic waves caused by pressure surges caused in the column of oil as described in "The Handbook of Applied Hydraulics" edited by Calvin Victor Davis, published by McGraw-Hill (1952). Modifications and variations such as would be apparent to a skilled addresses are deemed within the scope of the present invention.

We claim:

1. An oil well comprising:

a production tubular;

a pump barrel connected to the lower end of said production tubular;

a pump plunger reciprocably positioned within said pump barrel;

a sucker rod string connected to said pump plunger for raising and lowering said pump plunger within said pump barrel;

an annular jacket concentrically mounted about said production tubular at a point just above said pump barrel, said jacket forming a chamber about said production tubular;

means for communicating the interior of said production tubular with the interior of said chamber;

an inflatable bladder means positioned within said chamber and adapted to occupy substantially the entire volume of said chamber when fully inflated; and means for inflating said bladder means with a gas under pressure wherby fluids pumped by said pump plunger will act against said bladder means to compress said gas in said bladder means to allow a portion of said fluids to temporarily enter said chamber to thereby substantially reduce pressure surges arising from elastic deformation of a column of fluids.

2. The oil well of claim 1 wherein said means for inflating said bladder means comprises:

a conduit extending from the surface to said bladder means and adapted to be connected to a source of pressured gas at the surface; and a non-return valve means in said conduit for allowing flow of gas only in one direction, that being to the interior of said bladder means to inflate same.

3. The oil well of claim 2 wherein said means for fluiidly communicating the interior of said tubular with said chamber comprises:

openings through tubular adjacent said chamber.

4. The oil well of claim 2 wherein said bladder means is inflated to a pressure substantially equal to the static fluid pressure within said production tubular.

5. The oil well of claim 4 including:

a capillary tube means for exposing the interior of said bladder means to the fluid pressure in said tubular, said capillary tube means acting as a relief valve for excess pressure in said bladder means.

* * * * *